US008931140B2

(12) United States Patent
Salice

(10) Patent No.: US 8,931,140 B2
(45) Date of Patent: Jan. 13, 2015

(54) HINGE, PARTICULARLY FOR A FURNITURE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 13/390,416

(22) PCT Filed: May 24, 2011

(86) PCT No.: PCT/EP2011/058475
§ 371 (c)(1),
(2), (4) Date: Feb. 14, 2012

(87) PCT Pub. No.: WO2012/010350
PCT Pub. Date: Jan. 26, 2012

(65) Prior Publication Data

US 2013/0113355 A1 May 9, 2013

(30) Foreign Application Priority Data

Jul. 19, 2010 (IT) ..... MI2010A1326

(51) Int. Cl.
*E05F 1/08* (2006.01)
*E05F 5/00* (2006.01)

(52) U.S. Cl.
CPC ..... *E05F 5/006* (2013.01); *E05Y 2201/21* (2013.01); *E05Y 2201/256* (2013.01); *E05Y 2201/264* (2013.01); *E05Y 2600/60* (2013.01); *E05Y 2900/20* (2013.01)
USPC ..... 16/286; 16/54; 16/82; 312/326

(58) Field of Classification Search
USPC ..... 16/352, 286–288, 250, 49, 50, 54, 82; 312/326; 188/322.5
See application file for complete search history.

(56) References Cited

U.S. PATENT DOCUMENTS 7,552,509 B2 * 6/2009 Chen et al. ..... 16/50
7,669,285 B2 * 3/2010 Gallasch et al. ..... 16/286

(Continued)

FOREIGN PATENT DOCUMENTS

DE 20200762 U1 4/2002
DE 202005000876 U1 3/2005
WO 2009131348 A2 10/2009
WO 2010066372 A1 6/2010

OTHER PUBLICATIONS

International Search Report of the International Searching Authority corresponding to International Application No. PCT/EP2011/058475, mailed Jun. 29, 2011.

*Primary Examiner* — William Miller
(74) *Attorney, Agent, or Firm* — Amster, Rothstein & Ebenstein LLP

(57) ABSTRACT

The hinge, particularly for a furniture, comprises a hinge arm (5) which can be associated to a fixed part (1, 2) of the furniture, a hinge box (6) which can be associated to a movable part (3) of the furniture and connected to the hinge arm (5) in rotation between an opening position and a closing position of the hinge (4), at least one plate (28) having at least one seat (29) for at least one shock absorbing device (30) of the closing of the hinge (4) and/or for at least an assist device for the opening of the hinge (4), and at least one fixing element (21) in common with the hinge arm (5) and with the plate (28) for being fixed to the fixed part (1, 2) of the furniture.

14 Claims, 8 Drawing Sheets

(56) References Cited

U.S. PATENT DOCUMENTS

| | | | | |
|---|---|---|---|---|
| 7,712,185 | B2 * | 5/2010 | Pyo | 16/286 |
| 7,730,582 | B2 * | 6/2010 | Migli | 16/286 |
| 7,748,082 | B2 * | 7/2010 | Harald et al. | 16/286 |
| 7,814,618 | B2 * | 10/2010 | Lautenschlager | 16/286 |
| 7,900,321 | B2 * | 3/2011 | Fitz et al. | 16/362 |
| 8,561,262 | B1 * | 10/2013 | Liang et al. | 16/286 |
| 8,601,644 | B1 * | 12/2013 | Chen et al. | 16/286 |

* cited by examiner

HINGE, PARTICULARLY FOR A FURNITURE

The present invention refers to a hinge, particularly for furniture of the kind comprising a hinge arm, which can be associated with a fixed part of the furniture, and a hinge box which can be associated with a movable part of the furniture and connected to the hinge arm for rotation between an opening position and a closing position of the hinge.

In certain types, in particular those for which a return system is provided for closing the hinge during a closing step of the hinge, a fluid shock absorber is present, which can be compressed or not, placed in a seat present on a plate, fixed on the hinge arm and able to interfere with the movable part of the furniture, in order to decelerate the closing of the hinge and avoid the shock of the movable part of the furniture against the fixed part of the furniture.

Such types of hinges lament that an assembly of the plate to the hinge arm that is sometimes rather complex, or is such to need a modification of the structure of the hinge arm.

In some types, in order to obtain a simplified assembly, the shock absorber can be placed in such a position to have a limited efficiency.

In other types, the shock absorber has an optimum efficiency, which is obtained through a complicated structure of the complex formed by the plate and the hinge arm destined for its support.

The technical aim of the present invention is therefore to realize a hinge, particularly for a furniture, permitting to eliminate the technical drawbacks lamented in the known art.

Within this technical aim, a scope of the invention is to realize a hinge, particularly for a furniture, comprising at least one plate, having at least one seat for at least one fluid shock absorbing device which can be compressed or not or for another type of deceleration of the closing of the hinge and/or with at least one assist device for opening the hinge, in which the assembly of the hinge is particularly comfortable, simple, easy and rapid.

Another aim of the invention is to realize a hinge of the aforesaid type which permits to any device mounted on each plate to operate with the maximum efficiency.

Not last aim of the invention is to realize a hinge of the aforesaid type, which has a simplified structure.

The technical aim, and also these and other aims according to the present invention, are reached by realizing a hinge, particularly for a furniture, comprising a hinge arm, which can be directly fixed to a fixed part of the furniture, a hinge box, which can be associated to a movable part of the furniture and connected with said hinge arm with a rotation between an opening position and a closing position of the hinge, and at least one plate, having at least one seat for at least one deceleration device of any kind for closing the hinge and/or for at least an assist device for opening the hinge, characterized in that it comprises at least one fixing element common with said hinge arm and said plate, in order to be fixed to said fixed part of the furniture.

The fixing element preferably comprises a screw, placed through mutually mating holes or slots present in said hinge arm and in said plate.

The plate is positioned under said hinge arm, and can have one or more seats placed laterally with respect to a side of the hinge arm or one or more seats, each placed laterally with respect to a corresponding side of said hinge arm.

In a preferred embodiment of the invention, the plate has preliminary assembling means under said hinge arm, so that the group made by the plate and the hinge arm is then fixed through the fixing element to the fixed part of the furniture.

The preliminary assembling means of the plate to the hinge arm preferably comprise at least one through opening for engagement with a suitable engaging tooth.

In another preferred embodiment of the invention, the plate has preliminary assembling means with the fixed part of the furniture, so that first of all the plate is associated with the fixed part of the furniture, and then through the fixing element, the hinge arm is fixed at the same time to the plate and the assembly so formed with the fixed part of the furniture.

The preliminary assembling means of the plate with the fixed part of the furniture comprise, in addition to reference stops, in a first preferred embodiment an elastically yielding retaining flap, in a second preferred embodiment a hole for a fixing screw to said fixed part of the furniture, and in a third preferred embodiment a pin, which can be pressure engaged in a hole of said fixed part of a furniture.

Each seat can be realized integrally or separately from said plate and in this latter way, preferably regulation means of the seating position with respect to said plate are present.

In an alternative way, regulation means of the position can be provided in said at least one seat of said at least one shock absorbing device of any kind for the closing of the hinge and/or of the assist device for the opening of the hinge.

The present invention also refers in particular to a furniture of the American type, having a hinge with this shape, the arm of which is applied to the frame of the fixed part of the furniture with the interposition of said plate.

Further features and advantages of the invention will be more evident from the description of preferred but non exclusive embodiments of the hinge, particularly for a furniture according to the finding, shown in an indicative and non imitative way in the annexed drawings, in which:

FIG. 1 shows a perspective view of a furniture of the American type, before the assembly of the door, on which a hinge with a pre-assembled plate is fixed;

FIGS. 2*a*, 2*b*, 2*c* and 2*d* show different views of the structure of the hinge arm in FIG. 1;

Figure 18:
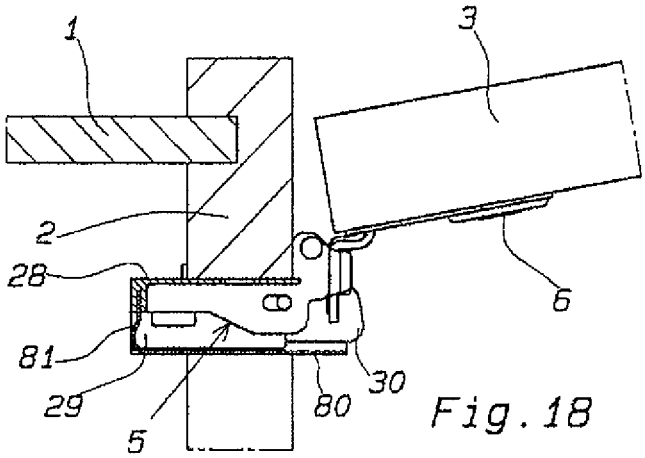
Figure 19:
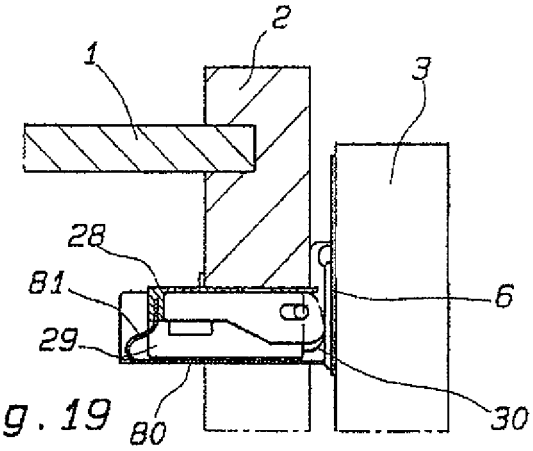
Figure 20:
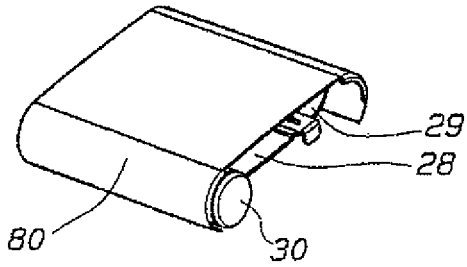

FIGS. 18 and 19 respectively show a first type of a covering element of the plate, in the position taken when the hinge is open and respectively closed;

FIG. 20 shows a second type of a covering element of the plate.

Equivalent parts of the various preferred embodiments of the finding will be indicated in the following with the same reference number.

With reference to the cited figures, a furniture of the American type is shown, comprising a movable part 3 of the furniture in particular a door, and a fixed part 1 of the furniture, comprising in turn a front frame 2.

The hinge of the present invention is however also applicable to a furniture of another type, for example to an European one, in which the fixed part 1 of the furniture does not comprise the frame 2.

The movable part 3 of the furniture is operatively connected to the frame 2 of the fixed part 1 of the furniture, by means of at least two hinges, one of which being indicated with 4, is shown in the Figures.

The hinge 4 comprises a hinge arm 5, which can be associated with a frame 2 and a hinge box 6 which can be associated to the movable part 3 of the furniture and is connected to the hinge arm 5 in a rotary way between an opening position and a closing position of the hinge 4.

The hinge box 6 is housed in a blind hole of the inner side of the movable part 3 of the furniture 3 to which it is fixed by means of screws 7.

The hinge arm 5 comprises a first angular element 8 having a first wing 9 supporting by means of a screw 24 a second element 10 hinged through a rotary pin 11 to the hinge box 6, and a second wing 12 substantially oriented in an orthogonal way to the first wing 9 and having sides 13 for driving the translational sliding of a third element 14 along the longitudinal direction L of the second wing 12.

When the hinge 4 is mounted on the furniture, the first wing 9 is destined to overlap the front surface 15 of the frame 2, whereas the second wing 12 is destined to overlap the lateral surface 16 of the frame 2 with its longitudinal axis L in the direction of the thickness of the frame 2.

The second wing 12 has a slot 17 which is transversally elongated to the longitudinal direction L and is associated with the third element 14 by means of an eccentric screw 18 crossing the slot 17 and a pin 19 which is blocked in an operative way in holes 20 provided in the sides 13 and longitudinally extended in the longitudinal direction L of the second wing 12.

The third element 14 has a slot 75 destined to house a fixing element of the hinge arm 5 to the frame 2.

The third element 14 permits to regulate the end of the position of the hinge arm 5 on the frame 2.

The regulation is so possible both in the direction of the thickness of the frame 2 and in the orthogonal direction of the thickness of the frame 2, in the first case due to the possible translation of the second wing 12 with respect to the third element 14 by actuating the eccentric screw 18, in the second case due to the longitudinal development of the slot 75, which permits to move the third element 14 with respect to the fixing element of the hinge arm 5 to the frame 2.

The third element 14 has teeth 22, 23 for their insertion on the thickness of the frame 2, and in particular two front teeth 22 and a rear tooth 23 separated from the two front teeth 22 of a distance equal to the thickness of the frame 2.

The hinge 4 has a return closing system, comprising an elastic flap 25 having an end interposed between a pin 26 and the inner surface of the base of the hinge box 6 and an end freely and sliding inserted in a window 27 present on the second element 10 of the hinge arm 5.

The flap 25 accumulates elastic energy by flexing during the acquisition of the opening position of the hinge 4, by means of the relative angular movement with respect to the hinge 6 and to the second element 10 of the hinge arm 5 by means of which the edge of the window 27 on which the flap 25 rests pushes against the flap 25 which flexes, having an interposed end.

During the closing of the hinge 4, the flap 25 discharges on the second element 10 the acquired elastic energy, transforming it in kinetic energy of the movable part 3 of the furniture.

According to the present invention, the hinge 4 comprises at least one plate 28 having at least one seat 29 for at least one fluid shock absorbing device 30 which can be compressed or not, preferably of a linear type, for decelerating the closure of the hinge.

In alternative or in combination with the shock absorbing device 30 it is possible to provide for an assist device at the opening of the hinge, for example a magnetic device like a ratchet of the known type.

The shock absorbing device 30 comprises a cylinder 35, in which a control piston of a stem 36 is housed, able to engage with the movable part 3 of the furniture, just before the position of complete closure of the hinge 4.

The plate 28 is positioned under the base of the hinge arm 5, from which it laterally protrudes in order to place each seat 29, provided on the same, laterally with respect to the side of the hinge arm 5.

In particular the plate 28 is positioned under the second wing 12 of the first angular element 8, besides that obviously under the third element 14, whereas each seat 29 provided on the same is laterally positioned with respect to a side 13 of the second wing 12 of the first angular element 8.

Each seat 29 is configured in order to house the corresponding shock absorbing device 30 oriented with its L'-axis in the same direction of the longitudinal L-axis of the second wing 12 of the first angular element 8 which in turn, when the hinge is applied to the furniture, is oriented in the same direction of thickness of the frame 2.

Each shock absorber 30, when the hinge is applied to the furniture, has the cylinder 35 or the stem 36 protruding from the front surface of the frame 2 in order to interfere with the movable part 3 of the furniture, during the final step of closing the hinge 4.

A particularly advantageous aspect of the hinge 4 is that the fixing element, in particular a fixing screw 21, is common with the hinge arm 5 and the plate 28 for their fixing to the frame 2.

In particular, the stem of the fixing screw 21 crosses the slot 17 and a slot 34 present in the plate 28 and mating with the slot 17, and it penetrates the frame 2 until the head of the fixing screw 21 interferes with the slot 17 such as to lock the hinge arm 5 against the plate 28 and this one against the lateral surface 16 of the frame 2.

Figure 1:
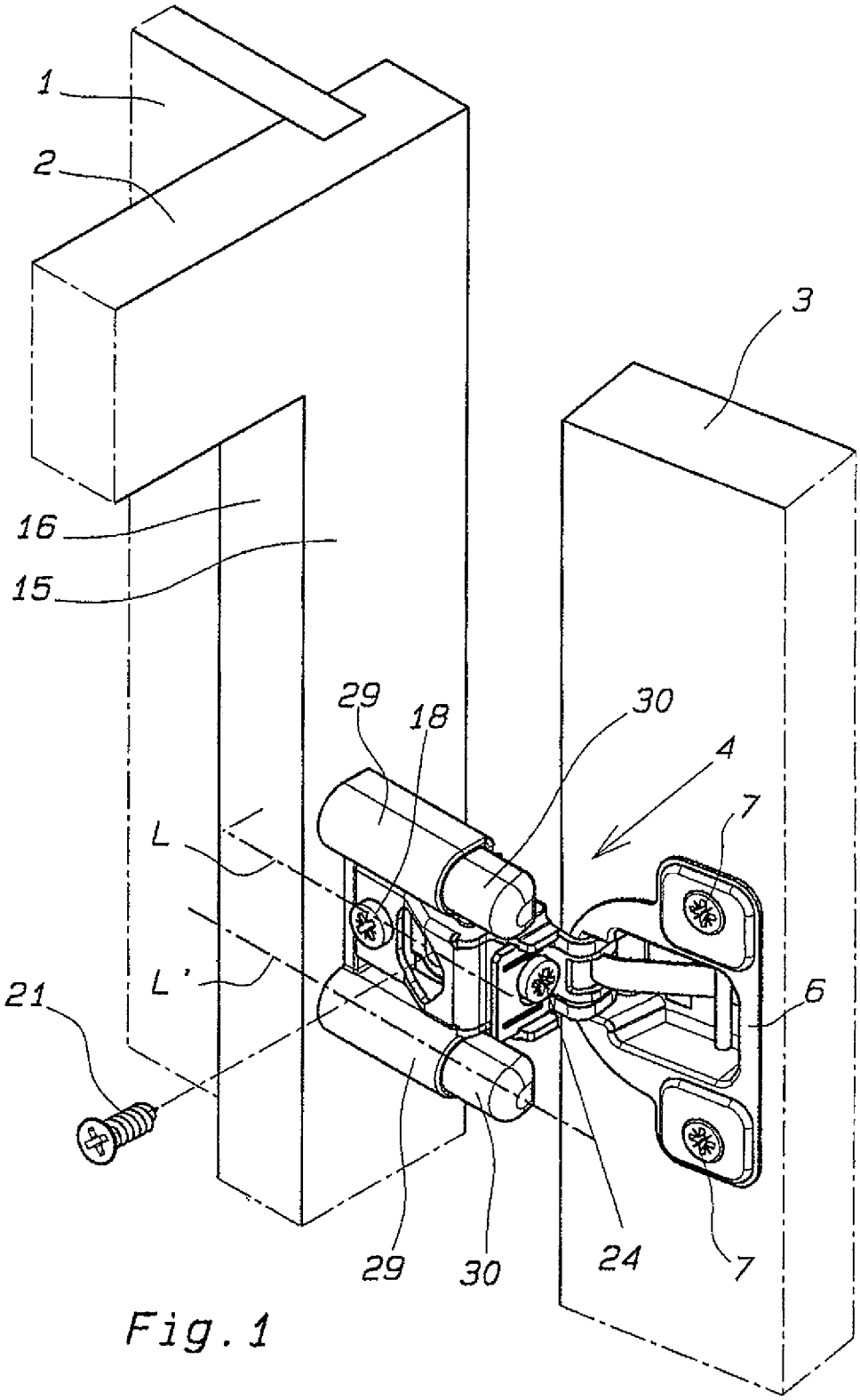
Figure 2A:
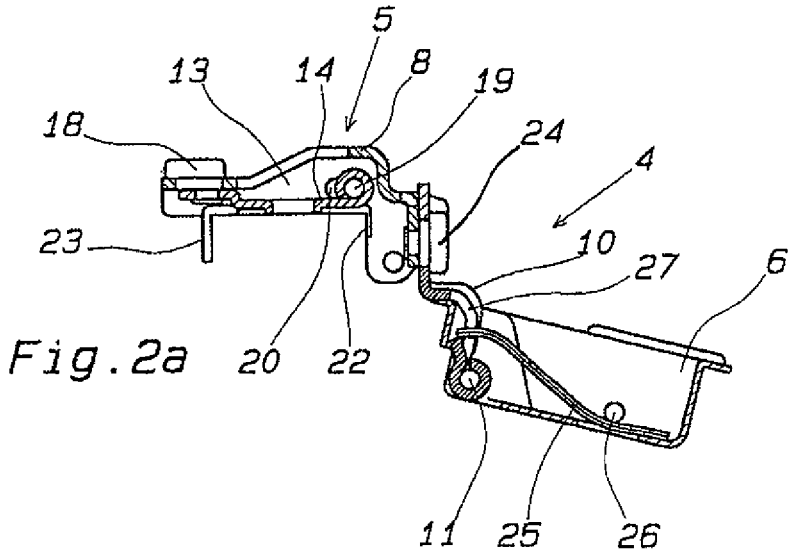
Figure 2B:
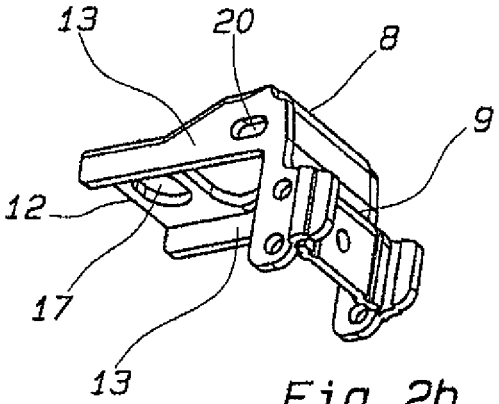
Figure 2C:
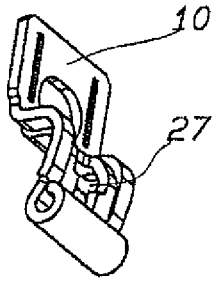
Figure 2D:
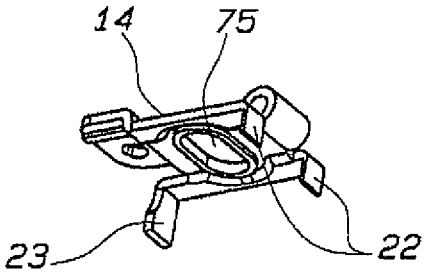
Figure 3:
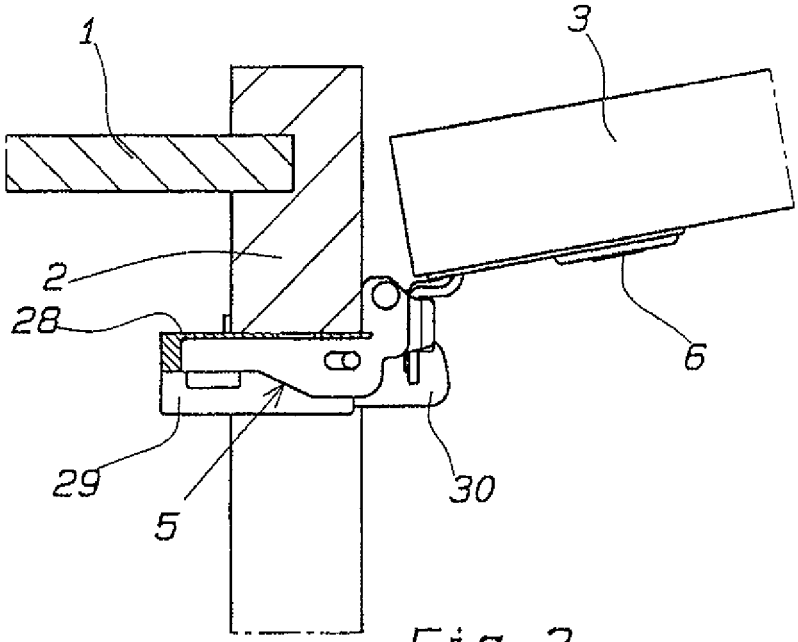
FIG. 3 shows a top view of the furniture in FIG. 1, with the assembled hinge and in an open position, and with the plate transversally sectioned along its centerline.
Figure 4:
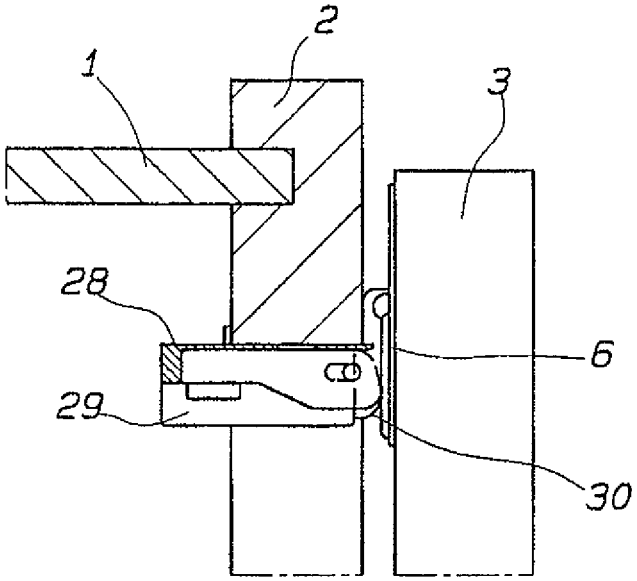
FIG. 4 shows a top view of the furniture corresponding to FIG. 3 with the hinge in a closed position.
Figure 5:
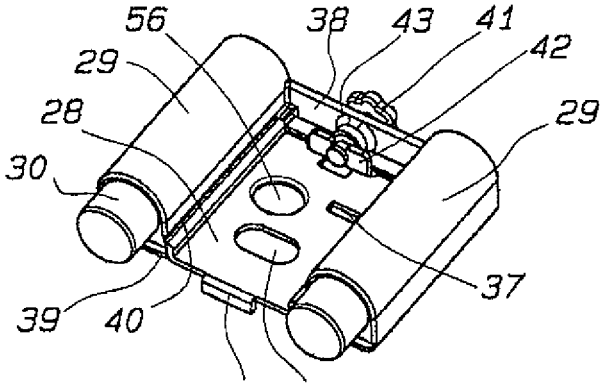
FIGS. 5 and 6 show perspective views of two preferred embodiments of the plate-seat assembly, suitable for regulating the seats with respect to the plate and also suitable for a preliminary assembly with the hinge arm.

Reference is now made to the various preferred embodiments of the finding, and in particular initially to FIG. 5.

The plate 28, of a substantially quadrangular shape, supports two tubular seats 29 which develop along the two lateral sides of the plate 28.

The plate 28 has preliminary assembly means with the hinge arm 5, represented by a through hole 37 in which the rear tooth 23 of the third element engages. The stability and central position of the preliminary assembly between the plate 28 and the hinge arm 5 is ensured also by the stop provided by the front teeth 22 of the third element 14 against which the edge of the front side of the plate 28 rests, which in turn has a front tooth 65 engaging between the same teeth 22.

In this solution regulating means of the position of the seats 29 with respect to the plate 28 are also present.

In particular the tubular seats 29 are mutually integral in a rear position with a connecting element 38 and they have along their lateral surface respectively a guide 39, extending under the raised edge 40 of a corresponding side, facing the plate 28, in order to permit the synchronized movement of the tubular seats 29 towards their axis.

The regulating means comprise a regulating screw 41 which is screwed in a threaded hole 43 present in the connecting element 38 and with a translation but it is not integral in rotation with a wing 42 protruding orthogonally from the rear side of the plate 28.

Figure 6:
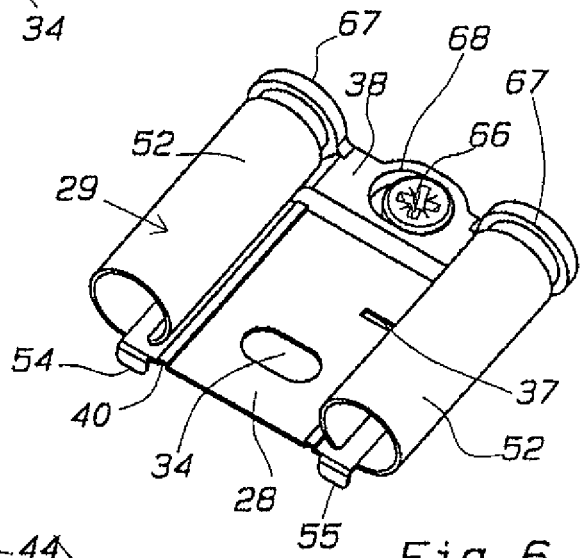

Reference is now made to FIG. 6.

The plate 28, preferably made of a sheet and with a quadrangular shape supports two lateral regions 52 which are curled in order to form the two tubular seats 29. The plate 28 has preliminary assembly means with the hinge arm 5, represented by a through hole 37 in which the rear tooth 23 of the third element 14 engages and from the edge of the front side 28 of the plate to which the front teeth 22 of the third element 14 adhere.

In this solution regulating means of the bottom of the seats 29 are present, with respect to the plate 28.

In particular the bottoms 67 of the tubular seats 29 are separated elements, driven in an axial and movable way in the curled regions 52 and are made mutually integral by a connecting element 38 provided with driving ribs (not shown) extending under grooves 40, placed on the plate 28 parallel to the curled zones 52 to permit the synchronized movement of the bottoms 67.

The regulating means comprise an eccentric 66 fixed in a rotary but not movable way, in a hole of the plate 28, and crossing an oval cavity 68 of the connecting element 38 which is orthogonally oriented with respect to the longitudinal axis L.

Figure 7:
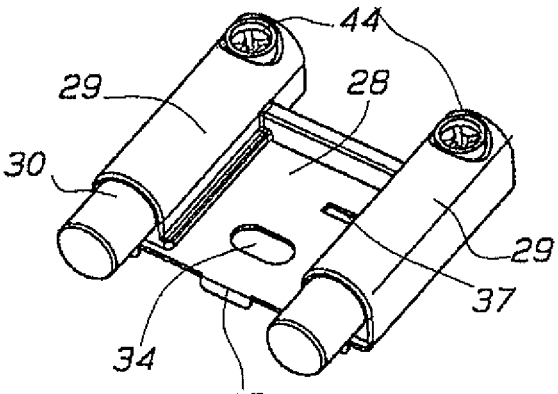
FIG. 7 shows a perspective view of a preferred embodiment of the plate-seat assembly, suitable for regulating each fluid shock absorber with respect to the corresponding seat, and also suitable for a preliminary assembly with the hinge arm.
Figure 8:
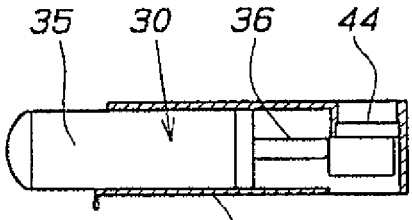
FIG. 8 shows a side elevation view of a section according to a diametral plane of a seat in FIG. 7.

Reference is now made to FIGS. 7 and 8.

To the plate 28, which has a substantially quadrangular shape, two tubular seats 29 are fixed, developing along the two lateral sides of the plate 28.

The plate 28 has preliminary assembly means with the hinge arm 5, represented as before with a through hole 37 in which the rear tooth 23 of the third element 14 engages. The stability of the preliminary assembly between the plate 28 and the hinge arm 5 is ensured as before also by the stop applied by the front teeth 22 of the third element 14 against which the edge of the front side of the plate 28 which in turn engages with a front tooth 65, engaging among the teeth 22 themselves. In this solution regulating means of the position of each shock absorbing device 30 or of an analogous device are also present in the respective seat 29.

In particular the regulating means comprise an eccentric screw 44 radially placed through the seat 29 and engaged with the base with the head of the stem 36 of the shock absorbing device 30 or with the container of another analogous device.

In this case the eccentric rotation of the screw 44 generates a push on the stem 36, which determines the axial movement of the entire shock absorbing device 30 or of the analogous device.

Figure 9:
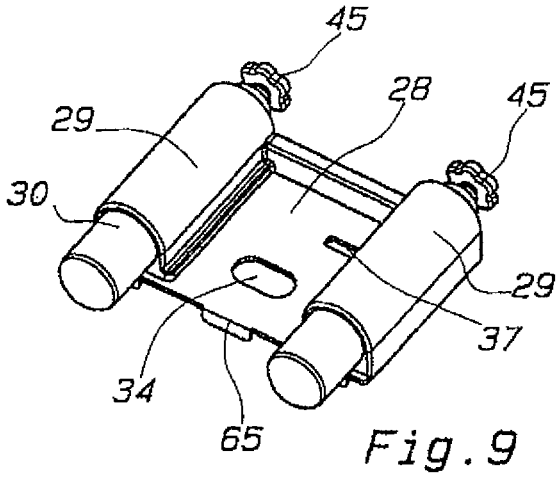
FIG. 9 shows a perspective view of a different preferred embodiment of the plate-seat assembly, suitable for regulating each fluid shock absorber with respect to the corresponding seat and also suitable to the preliminary assembly with the hinge arm.
Figure 10:
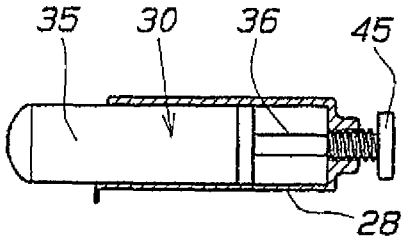
FIG. 10 shows a side elevation view of a section according to a diametral plane of a seat in FIG. 9.

Reference is now made to FIG. 9 or 10.

To the plate 28, with a substantially quadrangular shape two tubular seats 29 are fixed, developing along the two lateral sides of the plate 28.

The plate 28 has preliminary assembly means with the hinge arm 5, which are analogous to those present in the previously described embodiments according to FIGS. 5 and 6.

In this solution regulating means of the position of each shock absorbing device 30 in the respective seat 29 are also present.

In particular the regulating means comprise a screw 45 placed through the seat 29 coaxial with the stem 36 of the shock absorbing device 30 engaging the head of the same.

In this case, the rotation of the screw 45 generates an axial push on the stem 36 which determines the axial movement of the whole shock absorbing device 30.

Figure 11:
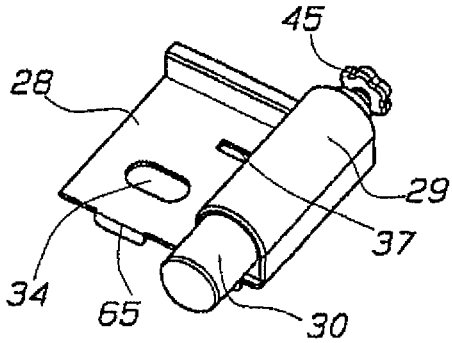
FIG. 11 shows a perspective view of a variant of the preferred embodiment or of the plate-seat assembly.

Reference is now made to FIG. 11.

The only difference with respect to the previous solution, is that to the plate 28, with a substantially quadrangular shape, only a tubular seat 29 is fixed, developing along one of the two lateral sides of the plate 28.

The plate 28 has the same preliminary assembly means with the hinge arm 5, and the same regulating means of the position of each decelerating means 30 are also present in their respective seat 29.

In the solutions represented in FIGS. 5 to 11, as shown, it is possible to initially associate the plate 28 to the hinge arm 5 and then to fix by means of the fixing element 21 the so obtained assembly to the frame 2.

Figure 12:
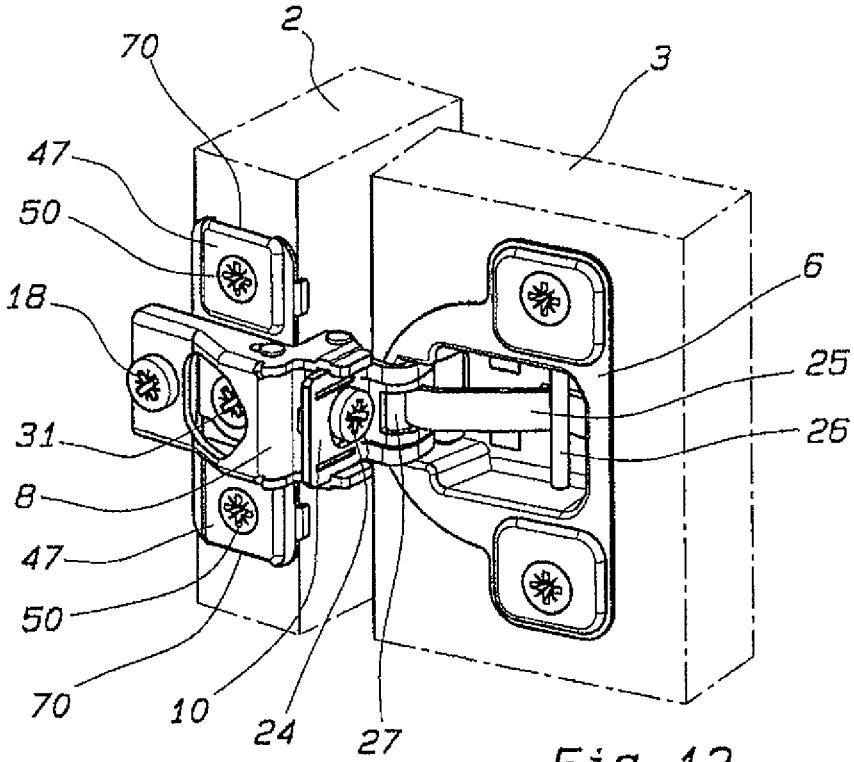
FIG. 12 shows a perspective view of a different preferred embodiment of a hinge arm, in which the seats can be assembled on the fixed part of the furniture, through the same fixing element, after the assembly of the hinge arm on the fixed part of the furniture.
Figure 13:
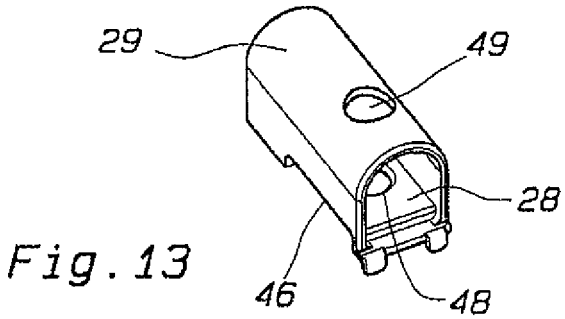
FIG. 13 shows a perspective view of a seat, suitable for the assembly on the hinge in FIG. 12.

Reference is now made to FIGS. 12 and 13.

With this solution it is possible to assemble the seats 29, with the plate 28, even after the assembly of the hinge arm on the frame 2. In this case the hinge arm 5 is strongly connected to a further small plate 47 protruding from both sides with respect to the sides 13 and connected to the third element 14 in a rotary way and perpendicular to the hinge arm 5 and to the thickness of the frame 16 by means of an eccentric 31.

The seat 29 externally has a recess 46 of a conjugated shape with respect to the portion of the small plate 47 laterally protruding from the hinge arm 5.

At the recess 46 the plate 28 has a hole 48 and the wall of the seat 29 is diametrically opposed to the hole 48 and has a further hole 49.

After having overlapped the seat 29 with the small plate 47 in such a way to match the recess 46 with the small plate 47, the seat 29 is fixed to the portion 47, passing a fixing screw 50 through the hole 49 and inserting it in the hole 48 and in the hole under the little plate 47.

Figure 14:
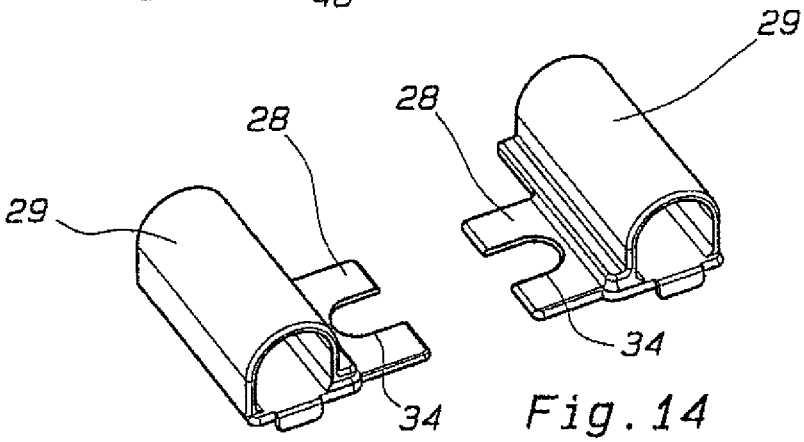
FIG. 14 shows a perspective view of a different preferred embodiment of a plate-seat assembly, permitting to assemble the plate after having temporarily associated the hinge arm to the fixed part of the furniture, through the fixing element which initially is not tightened or is loosened.

Reference is now made to FIG. 14.

This solution provides a plate 28 supporting only one seat 29 and provided with a slot 34, which this time is open and not closed, as it is shown on the contrary in all the preceding embodiments.

With this solution it is possible to assemble the plate 28 after having associated in a provisory way the hinge arm 5 to the frame 2 through screws 50 which are initially not tightened, or they are loosened for the application of the plate if the hinges have already been previously fixed on a furniture still existing since time.

At this point, it is possible to insert the plate 28 under the protruding portion of the small plate 47, through a suitable aperture 70, by inserting the slot 34 under the screw 50, and then to tighten the screw 50.

Figure 15:
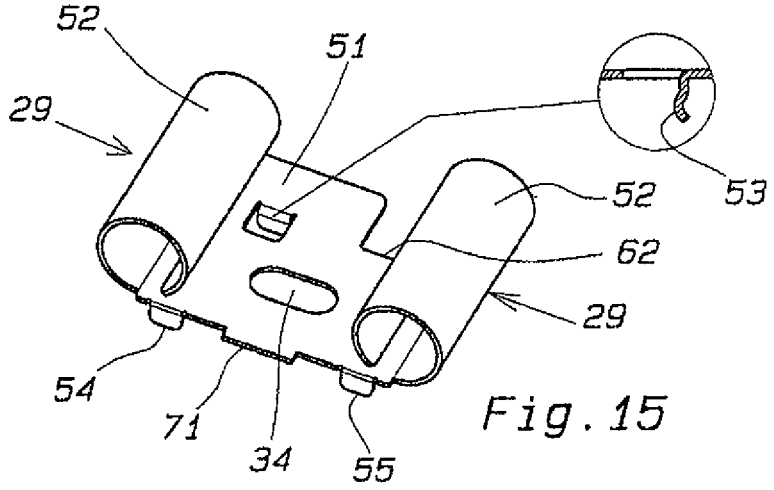
FIGS. 15, 16 and 17 show perspective views of three different preferred embodiments of the plate-seat assembly, which are suitable for the preliminary assembly with the fixed part of the furniture.

Reference is now made to FIG. 15.

The plate 28 is formed by a foil, preferably a sheet having a plan central region 51 with a substantially orthogonal shape, in which the slot 34 and two lateral curled regions 52 form the two tubular seats 29.

The rear side of the plan central zone 51 has an outlet 62 which permits to the rear tooth 23 of the third element 14 not to interfere with the plate 28, during the further assembly of the hinge arm 5 on the plate 28.

The plate 28 has preliminary mounting means with the frame 2, represented by a retaining flap 53 which is elastically yielding, orthogonally extending from the inside of the plane central zone 51 and from flaps 54, 55, orthogonally extending from the edge of the front side of the plane central zone 51 and which are separated from the retaining flap 53 at a distance slightly lower than the thickness of the frame 2, so that the plate 28 can be housed and kept on the thickness of the frame 2, by means of a slight elastic deformation of the retaining flap 53. For centring the hinge 4, the front side of the plate 28 has a front tooth 71 engaging among teeth 22 of the third element 14.

Figure 16:
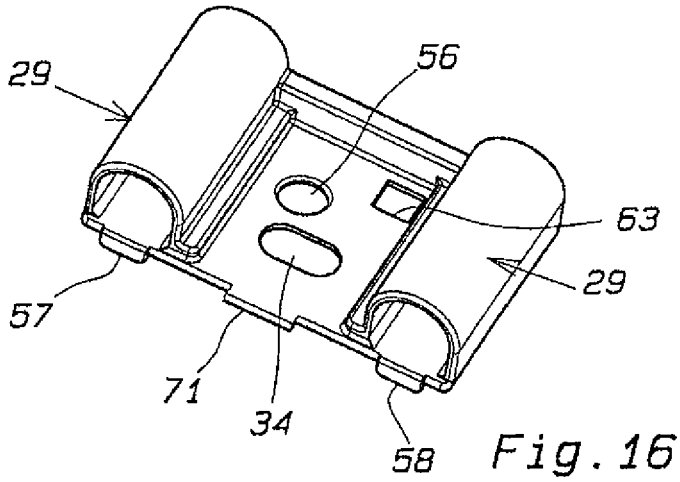

Reference is now made to FIG. 16.

To the plate 28, with a substantially quadrangular shape, having the slot 34, two tubular seats 29 are fixed, developing along the two lateral sides of the plate 28. The plate 28 has internally an outlet 63 which permits to the rear tooth 23 of the third element 14 not to interfere with the plate 28 during the further assembly of the hinge arm 5 on the plate 28. For centring the hinge a front tooth 71 is provided. The plate 28 has preliminary assembly means with the frame 2, represented with a hole 56 for a fixing screw (not shown) to the frame 2.

Suitable flaps 58, orthogonally extending from the edge of the plate 28, rest on the front surface 15 of the frame 2 in order to ensure that the plate 28 is previously assembled with the correct angular orientation.

Figure 17:
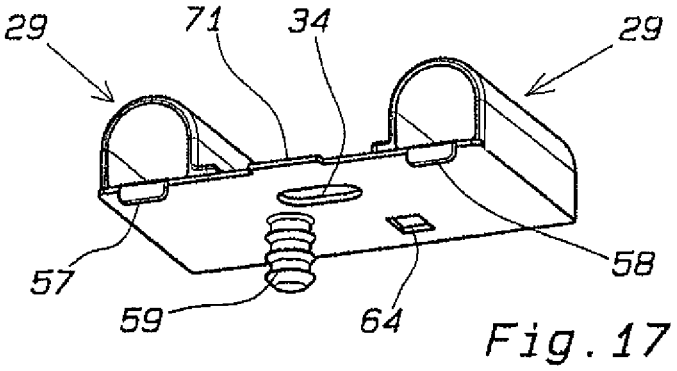

Finally, reference is made to FIG. 17.

To the plate 28, preferably of a plastic material and with a substantially quadrangular shape, having the slot 34, two tubular seats 29 are fixed, extending along the two lateral sides of the plate 28.

The plate 28 has internally an outlet 64, which permits to the rear tooth 23 of the third element 14 not to interfere with the plate 28 during the further assembly of the hinge arm 5 on the plate 28, and a centring front tooth 71.

The plate 28 has preliminary assembly means with the frame 2, represented by a pin 59 with a discontinuous profile, orthogonally extending from the plate 28 and which can be pressure engaged in a blind hole (not shown) made in the frame 2. Suitable flaps 57, 58, orthogonally extending from the edge of the plate 28, rest on the front surface 15 of the frame 2, in order to ensure that the plate 28 is preliminary mounted with the correct angular orientation.

In the solutions shown in FIGS. 15 to 17, as shown, it is possible to initially associate the plate 28 to the frame 2, and then to fix, by means of the fixing element 21, the hinge arm 5 to the plate 28 and the so obtained assembly to the frame 2.

The operation of the hinge 4 in a closing condition provides in a first step the creation of a closing moment for the action of the flap 25, and in a later step, the action of the fluid shock absorber 30 which, just before its complete closing, intercepts the movable part 3 of the furniture.

In the case in which the fluid shock absorber 30 is substituted by an assist device at the opening, as for example a ratchet of the known type, the operation of the hinge provides in a first step that the user applies a pressure on the closed door, so freeing the ratchet applying to the door a force sufficient to open it of an extent sufficient to the user to catch it and complete the opening movement. In the inverted closing movement, the user must apply the necessary push to load the ratchet and to bring it until its hooked position, in which the door is kept in the closed position. The invention is particularly advantageous in that it offers a range of assembly options which makes it always possible a simple, convenient and rapid assembly of the hinge, also in extremely different contexts.

The hinge for a furniture so conceived is susceptible of various changes and variants, all within the scope of the inventive concept; furthermore all the details can be substituted by technical equivalent elements.

For example the plate 28 can be integrally realized with the hinge arm 5, and in particular the plate 28 can be realized in a single piece, or be fixed in a manually non separated way with the third element 14.

Furthermore, it is possible to provide for a covering element 80 of the assembly, comprising the second wing 12 of the hinge arm and the plate 28 with each seat 29 provided on the same, the covering element of which is supported in a translational way along the longitudinal direction L of the second wing 12 of the hinge arm 5. In particular, when a shock absorber 30 is present, the translation in both senses of the covering element can be synchronized with that of the stem 36 or of the cylinder of the shock absorber 30 in order to ensure that this latter, in each configuration, be protected by the covering element. The synchronization of the movement of the covering element 80 with that of the stem 36 or of the cylinder 35 can be realized for example by means of suitable elastic means 81 which load themselves during the closing of the hinge and unload during the opening of the hinge (FIGS. 18 and 19).

As an alternative, the covering element 80 can be directly connected to the stem 36 or to the cylinder 35 of the shock absorber 30, so that it moves together with the same (FIG. 20).

In practice the used materials, and also their dimensions, can be of any kind, according to the needs and to the state of the art.

The invention claimed is:

1. A hinge comprising a hinge arm directly fixed to a fixed part of a furniture, a hinge box associated to a movable part of the furniture, and connected with said hinge arm in a rotary way, between an opening position and a closing position of the hinge, the hinge arm being provided with at least one hole or slot for at least one fixing element arranged for penetrating the fixed part of the furniture, and at least with one plate having at least one seat receiving at least one shock absorbing device for closing the hinge and/or at least one assist device for opening the hinge, characterized in that said plate is interposed between the hinge arm and the fixed part of the furniture, the plate being provided with at least one hole or slot mating with the hole or slot of said hinge arm in such a way that the at least one fixing element crosses said mating holes or slots of said plate and of said hinge arm and penetrates the fixed part of the furniture for fixing said hinge arm and said plate.

2. The hinge according to claim 1, characterized in that said fixing element comprises a screw placed among the holes or the mutually mating slots present in said hinge arm and in said plate.

3. The hinge according to claim 1, characterized in that said plate is positioned under the base of said hinge arm and laterally protrudes therefrom, in order to place said at least one seat laterally with respect to a corresponding side of said hinge arm.

4. The hinge according to claim 1, characterized in that said plate has preliminary assembling means under said hinge arm.

5. The hinge according to claim 4, characterized in that said preliminary assembly means comprise at least one opening passing through, for engaging with a suitable engaging tooth.

6. The hinge according to claim 1, characterized in that said at least one seat is realized integral with said plate.

7. The hinge according to claim 1, characterized in that said at least one seat is realized separate from said plate.

8. The hinge according to claim 7, characterized in that the hinge comprises regulation means of the position of said at least one seat with respect to said plate.

9. The hinge according to claim 1, characterized in that said plate has two seats each positioned laterally with respect to a corresponding side of said hinge arm.

10. The hinge according to claim 1, characterized in that the hinge comprises regulation means of the position in said at least one seat and/or of said at least one shock absorbing device of the closing of the hinge and/or at least one assist device for the opening of the hinge.

11. The hinge according to claim 1, characterized in that said plate is realized integral with said hinge arm.

12. The hinge according to claim 1, characterized in that the hinge has a covering element, comprising a wing of said hinge arm and said plate with the seat, said covering element being supported in translation along the longitudinal direction of said wing of said hinge arm.

13. A furniture comprising the hinge according to claim 1, in which said hinge arm is applied to the fixed part of the furniture, overlapping with said plate.

14. An American furniture, comprising the hinge according to claim 1, the furniture comprising a front frame, said hinge arm applied to said front frame.

* * * * *